US011003144B2

(12) United States Patent
Greenberg

(10) Patent No.: US 11,003,144 B2
(45) Date of Patent: May 11, 2021

(54) CLOCK WITH LIGHTING ELEMENTS

(71) Applicant: Russell Greenberg, Long Island City, NY (US)

(72) Inventor: Russell Greenberg, Long Island City, NY (US)

(73) Assignee: GRADUAL LLC, Long Island City, NY (US)

( * ) Notice: Subject to any disclaimer, the term of this patent is extended or adjusted under 35 U.S.C. 154(b) by 237 days.

(21) Appl. No.: 16/111,554

(22) Filed: Aug. 24, 2018

(65) Prior Publication Data

US 2020/0064780 A1 Feb. 27, 2020

(51) Int. Cl.
*G04G 9/00* (2006.01)

(52) U.S. Cl.
CPC ..... *G04G 9/00* (2013.01)

(58) Field of Classification Search
CPC ..... G04G 9/00; G04G 9/045; G04G 9/06; G04G 9/047; G04G 9/02; G04B 19/00; G04B 19/207; G04B 45/0007; G04B 19/21
USPC ..... 368/241
See application file for complete search history.

(56) References Cited

U.S. PATENT DOCUMENTS 4,034,554 A * 7/1977 Hadany ..... G04B 19/04 368/221
5,694,376 A * 12/1997 Sullivan ..... G04G 9/02 368/240
2009/0201772 A1* 8/2009 Billeaudeaux ..... G04G 9/02 368/82
2017/0082979 A1* 3/2017 Smith ..... G04G 9/0029

FOREIGN PATENT DOCUMENTS

DE 4135514 A1 * 2/1993 ..... G04G 9/02

* cited by examiner

*Primary Examiner* — Edwin A. Leon
(74) *Attorney, Agent, or Firm* — Andrew S. Langsam

(57) ABSTRACT

A visual time clock comprises a set of vertically stacked or adjacent chambers, each of the at least two chambers having interior-located, connected LED strips which are electronically controlled and selectively powered by being turned on or off or dimmed or brightened as time passes. Each chamber is meant to visually show an amount of elapsed time, e.g., seconds, minutes, hours and days (and years and century, if desired). When one chamber visually fills with the timed illumination of the LEDs, it will void and reset its LEDs and simultaneously illuminate one or more of the LEDs of the adjacent chamber.

19 Claims, 6 Drawing Sheets

CLOCK WITH LIGHTING ELEMENTS

FIELD OF THE INVENTION

The present invention generally relates to clocks or timers. More particularly, the present invention is directed to a clock with lighting elements embedded within, wherein the lighting elements can be used to indicate various units of time.

BACKGROUND OF THE INVENTION

Clocks can comprise many different forms, including quartz watches to atomic clocks. In this way, various techniques exist for measuring and indicating the time. Clocks generally comprise a clock face with moving clock hands with numbers or indices around the periphery thereof (e.g., for analog clocks) or a digital display (e.g., for digital clocks) for indicating the time. A clock face in its most basic form is well recognized, but clocks generally have not been stylistically developed. In this regard, a novel way to measure and indicate time in a decorative manner is desired.

SUMMARY OF THE INVENTION

The following discloses a simplified summary of the specification in order to provide a basic understanding of some aspects of the specification. This summary is not an extensive overview of the specification. It is intended to neither identify key or critical elements of the specification nor delineate the scope of the specification. Its sole purpose is to disclose some concepts of the specification in a simplified form.

Disclosed is a clock comprising a discrete chamber, and/or a plurality of chambers linked in a series, wherein the chambers represent the passage of time as accumulations of light within the chambers. In various embodiments, a chamber can be a vessel, physical or virtual comprising lighting means, which has a defined length or volume, the length or volume of which is assigned a temporal value by a controller unit that is configured to execute instructions (e.g., a computer program) stored in a memory unit that is operatively connected to the controller unit. For example, a one (1) foot long chamber can be equivalent to a year, or a region of pixels that is 240 pixels long can be equivalent to a day. Droplets of light can appear to enter from the top of the top-most chamber at a variable frequency set by the computational program. Each droplet represents a fraction of the overall value of time represented by the length or volume of space in the chamber. These droplets of light accumulate in the chamber at a rate defined by the program, eventually filling the chamber with light to display that a predetermined period of time has completely elapsed. Once full, the chambers void their contents (i.e., light), in a timely manner so as to make "room" in the chamber for the next droplet of light. The droplets continuously fall at the predetermined rate such that the filling and emptying process can continue.

For example, if a droplet of light falls every minute, and a chamber fills up every hour, a viewer will know when a minute has elapsed when a droplet falls, and will know it is roughly thirty (30) minutes past the hour when the chamber is half full of light. The moment the last droplet fills the chamber completely it will be the sixtieth minute in the hour and all of the light will drain out of the bottom of the chamber. In other words, the chamber will be completely empty of light at that moment (i.e., zero minutes into the next hour), and the next droplet that falls into the chamber will mark the completion of the first minute in the next hour (e.g. 6:01 am).

If the chamber is linked to another chamber (e.g., an adjacent chamber) in a series, the drained light from the chamber (i.e., worth one hour) appears to form a droplet that falls into the adjacent chamber, which must be of a temporal value greater than one hour. In various embodiments, the adjacent chamber can represent a day. In this way, each droplet from the chamber representing an hour fills $1/24^{th}$ of the volume of the chamber representing a day. This cascading effect continues with each adjacent chamber.

BRIEF DESCRIPTION OF THE DRAWINGS

The detailed description is described with reference to the accompanying figures, in which the left-most digit(s) of a reference number identifies the figure in which the reference number first appears. The use of the same reference numbers in different figures indicates similar or identical items.

DETAILED DESCRIPTION OF THE INVENTION

The present invention is directed towards a clock comprising an elongated housing member with internal lighting components embedded therein. The lighting components can illuminate different volumes of the housing member in order to indicate various units of time. For purposes of clarity, and not by way of limitation, illustrative views of the present clock are described with references made to the above-identified figures. Various modifications obvious to one skilled in the art are deemed to be within the spirit and scope of the present invention. Additionally, as used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to disclose concepts in a concrete fashion. As used in this application, the term "or" is intended to mean an inclusive "or" rather than an exclusive "or." Additionally, the articles "a" and "an" as used in this application and the appended claims should generally be construed to mean "one or more" or "at least one" unless specified otherwise or clear from context to be directed to a singular form. It is to be appreciated that determinations or inferences referenced throughout the subject specification can be practiced through the use of artificial intelligence techniques.

Figure 1:
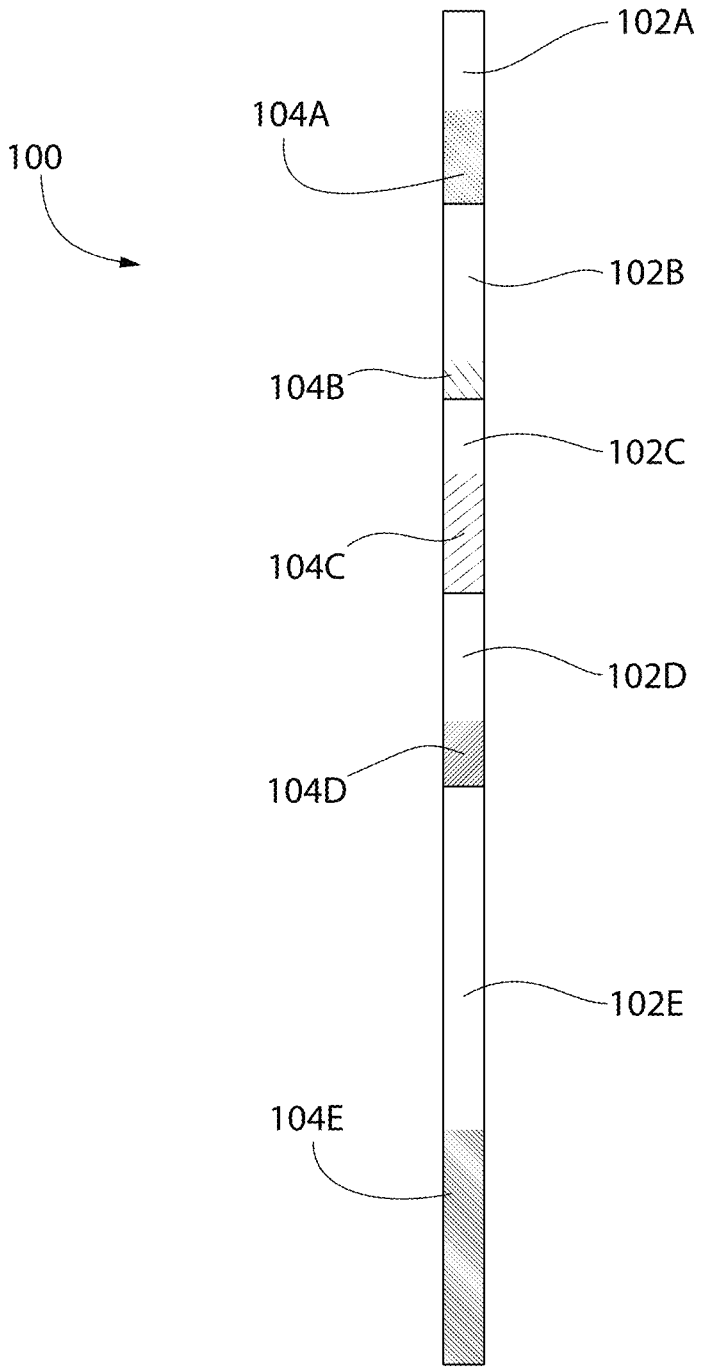
FIG. 1 shows a block diagram of the clock that is calibrated to display time in minutes, hours, days, years, and centuries.
Figure 2:
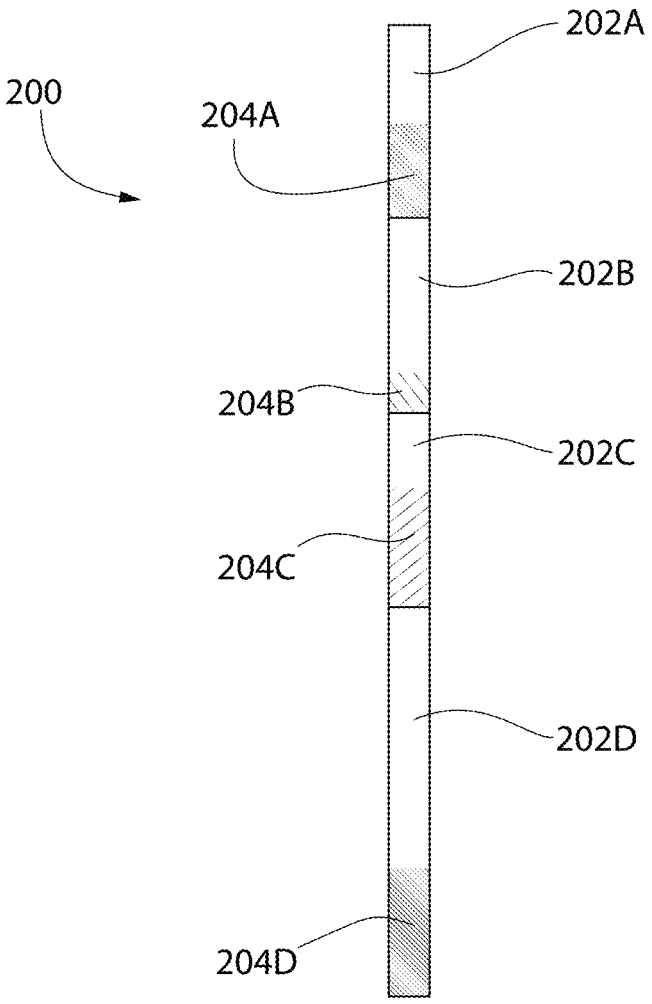
FIG. 2 shows a block diagram of the clock that is calibrated to display time in minutes, hours, days, and years.
Figure 3:
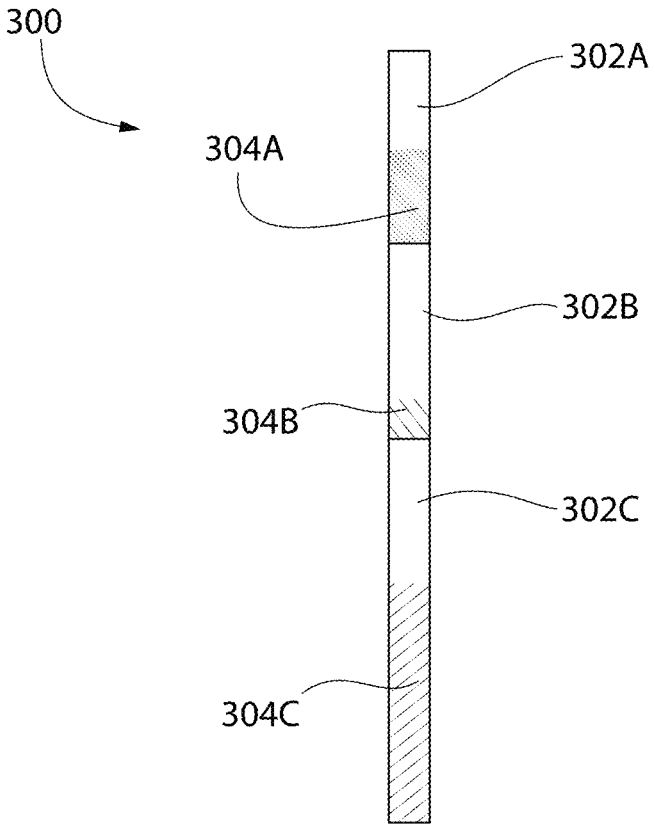
FIG. 3 shows a block diagram of the clock that is calibrated to display time in seconds, minutes, and hours.

Referring now to FIGS. 1 through 3, there are shown various embodiments of the clock of the present invention. The clock 100 comprises a housing member having one or more hollow chambers or compartments, each of the chambers or compartments having a defined volume or length.

Additionally, the length of each of the chambers is the distance between the top end of the chamber and the bottom end of the chamber. Preferably, each chamber is visually distinct from its adjacent chamber. For instance, each chamber can be separated from its adjacent chamber via a divider or a connecting element that may be composed of a different material and/or color. Additionally, or alternatively, a division between chambers can also be expressed through a geometric change in the shape of the clock or its chambers. The housing member comprises a circular cross-section so as to form a substantially cylindrical shape. The diameter of the cross-section of the housing member is constant over the length of the housing member such that the diameter of the cross-section of each of the one or more chambers is substantially equal. In various embodiments, however, the housing member can comprise different shapes and dimensions. For instance, the housing member can comprise a substantially cuboid shape. In various embodiments, the chambers can comprise various display devices such as an LCD screen of various shapes and dimensions.

In various embodiments, the clock 100 comprises a first chamber 102A, a second chamber 102B, a third chamber 102C, a fourth chamber 102D, and a fifth chamber 102E, wherein each of the chambers represents a unit of time. More specifically, each of the chambers comprises a temporal value correlating to its length or volume. For instance, the first chamber 102A represents time in minutes, the second chamber 102B represents time in hours, the third chamber 102C represents time in days, the fourth chamber 102D represents time in years, and the fifth chamber 102E represents time in centuries. Thus, adjacent chambers represent the previous or the next unit of time in a sequential manner. Accordingly, each chamber can be configured to represent other units of time. For example, the first chamber 102A can also represent time in seconds, the second chamber 102B can also represent time in minutes, the third chamber 102C can also represent time in hours, the fourth chamber 102D can also represent time in days, and the fifth chamber 102E can also represent time in years.

The number of chambers can vary depending upon embodiments. Accordingly, the housing member can comprise more or fewer than five chambers. For instance, the clock 200 comprises a housing member having a first chamber 202A representing time in minutes, a second chamber 202B representing time in hours, a third chamber 202C representing time in days, and a fourth chamber 202D representing time in years. In various embodiments, the clock 300 comprises a housing member having a first chamber 302A representing time in seconds, a second chamber 302B representing time in minutes, and a third chamber 302C representing time in hours. It is noted that the chambers 202A-302C can represent other units of time as discussed above. In various embodiments, the clock can comprise a single chamber that represents any unit of time (e.g., one day, one year, etc.).

The length of each of the chambers can differ based at least partially on the unit of time that the chambers represent. For instance, the length of the first chamber 102A representing time in minutes is less than the length of the fifth chamber 102E representing time in centuries. Additionally, the length of each of the chambers can differ based on the number of chambers in the housing member. For instance, the length of the first chamber 102A of the first clock 100 representing time in minutes is less than the length of the first chamber 202A of the second clock 200 representing time in minutes. Alternatively, the length of each of the chambers can be substantially equal in order to provide a uniform appearance. Thus, the length of a chamber is not necessarily indicative of the unit of time that the chamber represents.

The housing member comprises a light assembly embedded therein. In various embodiments, the light assembly can comprise one or more strips of light-emitting diode (LED) lights, wherein the LED lights span between the top and bottom ends of the housing member. In this way, the LED lights also span between the top-most chamber (e.g., the first chamber 102A) and the bottom-most chamber (e.g., the fifth chamber 102E). In various embodiments, the chambers can comprise an LCD screen with a vertical strip of pixels isolated to form virtual chambers. Additionally, or alternatively, each of the chambers can comprise a separate light assembly. For instance, the clock 100 can include the first chamber 102A comprising a first light assembly 104A, the second chamber 102B comprising a second light assembly 104B, the third chamber 102C comprising a third light assembly 104C, the fourth chamber 102D comprising a fourth light assembly 104D, and the fifth chamber 102E comprising a fifth light assembly 104E. The first light assembly 104A, the second light assembly 104B, the third light assembly 104C, the fourth light assembly 104D, and the fifth light assembly 104E can be operatively connected to each other in order to coordinate lighting configurations. Additionally, or alternatively, the first light assembly 104A, the second light assembly 104B, the third light assembly 104C, the fourth light assembly 104D, and the fifth light assembly 104E can be operatively connected to a controller unit or a remote electronic device for operating lighting configurations. The lighting assemblies 104A-104E can operate concurrently such that two or more chambers are illuminated at the same time.

Similarly, the clock 200 can include the first chamber 202A comprising a first light assembly 204A, the second chamber 202B comprising a second light assembly 204B, the third chamber 202C comprising a third light assembly 204C, and the fourth chamber 202D comprising a fourth light assembly 204D. Additionally, the clock 300 can include the first chamber 302A comprising a first light assembly 304A, the second chamber 302B comprising a second light assembly 304B, and the third chamber 302C comprising a third light assembly 304C.

The one or more strips of LED lights can be secured to the interior wall of the housing member in a linear fashion such that it is substantially parallel to the housing member and the vertical axis. In this regard, the one or more strips of LED lights can illuminate the chambers, but the LED lights are not visible from the exterior of the housing member. Various techniques for securing the LED lights to the interior wall of the housing member can be used, such as adhesives, fasteners, and/or so forth. The one or more strips of LED lights comprises a plurality of LED bulbs that are spaced apart at regular intervals. As the length of each of the chambers differs, the number of LED bulbs that span each of the chambers can differ. In various embodiments, the chambers can comprise light blockers to prevent illuminated LED bulbs in one chamber from bleeding into its adjacent chamber.

Each chamber 102A-102E can be split up into a number of sections equivalent to the number of LED bulbs disposed within the respective chamber. For instance, if sixty (60) LED bulbs span from the bottom end of the first chamber 102A to the top end of the first chamber 102A, the first chamber 102A is split up into sixty (60) sections and each LED bulb represents one (1) minute. In this way, one (1) LED bulb can illuminate per minute within the first chamber 102A. In another example, if thirty (30) LED bulbs span from the bottom end of the first chamber 102A to the top end of the first chamber 102A, the first chamber 102A is split up into thirty (30) sections and each LED bulb represents two (2) minutes. In this way, one (1) LED bulb can illuminate every two (2) minutes within the first chamber 102A. Thus, the LED bulbs can be configured to illuminate at different rates depending upon embodiments.

In various embodiments, the first chamber 102A representing minutes can illuminate from its bottom end to the top end over a span of sixty (60) minutes or one (1) hour. Thus, if fifty (50) out of sixty (60) LED bulbs are illuminated, 5/6 of the volume of the first chamber 102A is illuminated and the first chamber 102A indicates that fifty (50) minutes have passed. Similarly, if fifteen (15) out of thirty (30) LED bulbs are illuminated, ½ of the volume of the first chamber 102 is illuminated and the first chamber 102A indicates that thirty (30) minutes have passed. After all of the LED bulbs in the chamber 102A is illuminated (i.e., the entire volume of the chamber 102A is illuminated), the lights reset and all of the LED bulbs in the to chamber 102A are extinguished and one or more LED bulbs in the adjacent chamber (i.e., the second chamber 102B representing hours) is illuminated to indicate that one (1) hour has passed. Thereafter, the LED bulbs in the first chamber 102A can illuminate from the beginning (e.g., from the bottom end of the first chamber 102A to the top end thereof) and this process is repeated. In this regard, there is a conservation of temporal value in each clock, so that when one chamber 102A voids light into the adjacent chamber 102B below, the light occupies the appropriate proportion within the chamber 102B. For instance, if the first chamber 102A representing minutes voids into the second chamber 102B representing hours, 1/60 of the second chamber 102B is illuminated. Similarly, if the third chamber 102C representing days voids into the fourth chamber 102D representing years, 1/365 of that chamber of the fourth chamber 102D is illuminated, and so forth.

In various embodiments, each chamber 102A-102E can be split up into a number of sections in accordance with its length. For instance, if the chamber 102C is six (6) inches long and represent a day, the controller is configured to automatically calculate how may LED bulbs to illuminate based on the length of the chamber 102C such that each droplet of light within the chamber 102C appears to the viewer as $1/24^{th}$ of the length of volume of the chamber 102C. In various embodiments, one or more LEDs can partially illuminate to create an illusion that the chamber 102C is illuminating evenly along the length thereof.

In various embodiments, the lighting assemblies can be calibrated to illuminate based at least partially on a unit of time that a chamber represents. For example, if the third light assembly 104C is calibrated to a day, the third chamber 102C is completely illuminated over a twenty-four (24) hour period, emptying or extinguishing at midnight. If the second light assembly 104B is calibrated to an hour, the second chamber 102B fills completely over a sixty (60) minute period. If the fourth light assembly 104D is calibrated to a year, the fourth chamber 102D fills completely over a three hundred sixty-five (365) day period (or over a three hundred sixty-six (366) day period on leap years), emptying at midnight on New Year's Eve.

It is noted that the first chamber 102A representing minutes can illuminate from its bottom end to the top end and/or vice versa over a span of any given amount of time. In this regard, the bottom-most LED bulb in the chamber 102A can illuminate first when the chamber 102A illuminates from the bottom end thereof. Alternatively, the top-most LED bulb in the chamber 102A can illuminate first when the chamber 102A illuminates from the top end thereof. In various embodiments, the first chamber 102A can illuminate over a span of one hundred and twenty (120) minutes or two (2) hours. Thus, if the first chamber 102 comprises sixty (60) LED bulbs, each LED bulb represents two (2) minutes. In this way, one (1) LED bulb can illuminate every two (2) minutes within the first chamber 102A. Additionally or alternatively, one (1) LED bulb can partially illuminate every one (1) minute within the first chamber 102A.

The LED lights of the lighting assemblies 104A-104E can illuminate each chamber 102A-102E such that each chamber 102A-102E illuminates from the bottom end to the top end thereof and/or vice versa in accordance with the unit of time that each respective chamber represents. Accordingly, the LED bulbs can illuminate from the top or from the bottom of each of the chambers. In various embodiments, the LED assembly can be programmed to display various lighting effects for one or more chambers. For instance, the LED assembly can be programmed to display a falling raindrop effect, a glow effect, a flash effect, a fade effect, a twinkle effect, a steady-on effect, an hourglass effect, and/or so forth. Additionally, the LED assembly can be programmed to display animations. For example, the LED bulbs can illuminate to display dancing water and slosh dynamics. In this regard, the LED bulbs can illuminate in accordance with the shape, dimension, and/or movement of the chamber, which can be sensed via one or more sensors (e.g., accelerometers). For instance, if the housing member sways from side to side, the LED bulbs in the chambers can illuminate to show sloshing and splash effect. Additionally, the LED assembly can be programmed to display various colors. Thus, the LED bulbs can comprise various colors.

When using the raindrop effect, a plurality of consecutive LED bulbs can flash downward along the length of the chambers in a substantially sequential manner in order to depict raindrops. Each raindrop can represent an amount of time within a chamber. If one LED bulb represents one minute in the first chamber 102A, the LED assembly can be programmed to flash LED bulbs within the first chamber 102A such that raindrops fall at regular intervals (e.g., every second) until sixty (60) seconds have passed and one LED bulb representing one minute is illuminated. Additionally, or alternatively, two LED bulbs can illuminate at a time within the first chamber 102A every one hundred and twenty (120) seconds, and/or so forth. In this way, the LED assembly creates a visual effect of each chamber filling up (e.g., from the bottom of the chamber) at a predefined drop rate with a volume of light as time passes. Without disrupting the duration of these overarching cycles, the frequency that the droplets fall can be changed. For example, they can be set to fall every second, or every fraction of a minute. If the first chamber 102A measures a minute and the raindrop effect occurs every second, then each droplet is worth 1/60th of the volume of the chamber 102A. If the raindrop effect occurs every two seconds, then each droplet is worth 1/30th of the volume of the chamber 102A.

In various embodiments, each chamber comprises a headspace such that a portion of the volume of the chamber at or near one or more terminal ends (i.e., the top end or the bottom end) of the chamber is not illuminated. For example, if the first chamber 102A comprises sixty-five (65) LED bulbs, five (5) of the LED bulbs may not be illuminated to create space at the top end of the first chamber 102A. The remaining sixty (60) LED bulbs can be illuminated over a span of given time. The headspace in the chamber allows a user to see the one or more lighting effects that would otherwise not be easily shown (e.g., raindrops).

After all or a predetermined number of the LED bulbs of the first light assembly 104A in the first chamber 102A is illuminated over a predetermined period of time, the first light assembly 104A resets by extinguishing all of the LED bulbs of the first light assembly 104A. For example, if the first chamber 102A comprises sixty-five (65) LED bulbs, the first light assembly 104A can reset when sixty (60) LED bulbs are illuminated, assuming that five (5) LED bulbs are not illuminated to serve as a headspace in the first chamber 102A. In various embodiments, one or more sensors operatively connected to the light assembly 104A can sense when a predetermined number of LED bulbs is illuminated in order to trigger the LED bulbs via a controller unit to reset. Concurrently, the first light assembly 104A can trigger the second light assembly 104B in the second chamber 102B to display a lighting effect. For instance, the LED bulbs of the second light assembly 104B can display a falling raindrop effect or a flash effect to make the lights in the first chamber 102A appear to be emptied into the second chamber 102B, and then one or more LED bulbs in the second chamber 102B is illuminated. In other words, the lights in the first chamber 102A would appear to display the effect of the liquid voiding or draining out of the bottom of the first chamber 102A, as if forced through by gravity into the second chamber 102B. This process can repeat such that when the LED bulbs of the second light assembly 104B in the second chamber 102B is illuminated, the second light assembly 104B resets by extinguishing all of the LED bulbs of the second light assembly 104B. Concurrently, the second light assembly 104B can trigger the third light assembly 104C in the third chamber 102C to display a lighting effect. For example, the LED bulbs of the third light assembly 104C can display a falling raindrop effect or a flash effect to make the lights in the second chamber 102B appear to be emptied into the third chamber 102C, and then one or more LED bulbs in the third chamber 102C is illuminated.

In various embodiments, the LED assembly can also be programmed to illuminate the correct volume of light by altering the brightness or the dimness of the LED bulbs. For instance, if the first chamber 102A comprises fifty (50) LED bulbs, the brightness of the bulbs can be adjusted such that not all of the bulbs are completely illuminated until sixty (60) minutes or one (1) hour has passed. Additionally, or alternatively, the LED bulbs can brighten or dim to create an illusion of an even fill-rate. In various embodiments, the chambers 102A-102E can comprise diffusers that can blur light to help create the illusion of evenness or even fill-rate.

In various embodiments, the clock 100-300 can be calibrated to measure and indicate time on planets other than Earth. For example, the clock 100-300 can be configured to measure and indicate Martian time. In this regard, a chamber representing a unit of time in days can completely illuminate over a twenty-five (25) hour period instead of a twenty-four (24) hour period.

Figure 4:
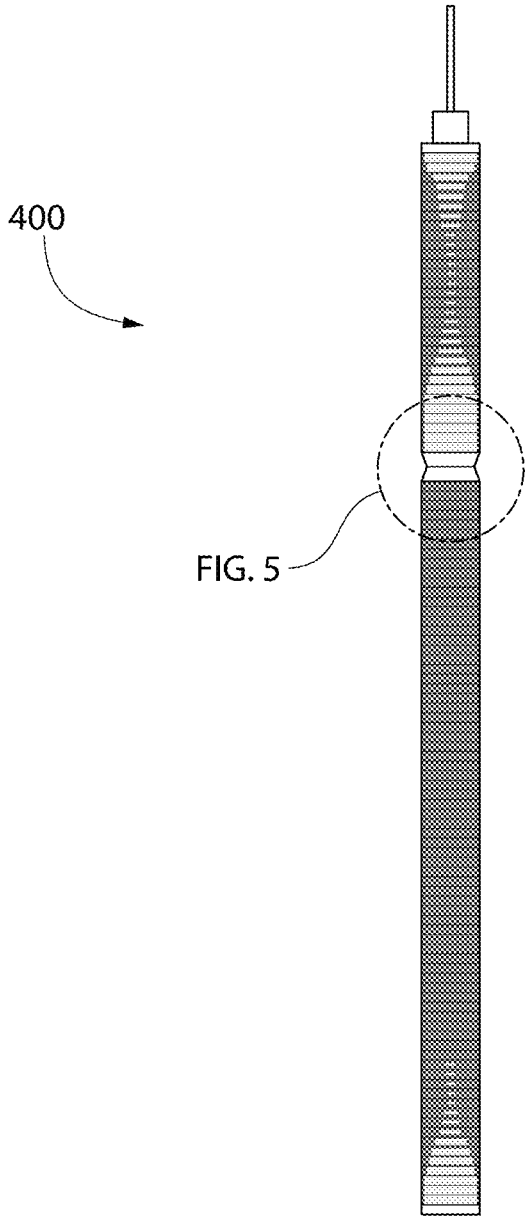
FIG. 4 shows a side elevational view of one embodiment of the present invention.
Figure 5:
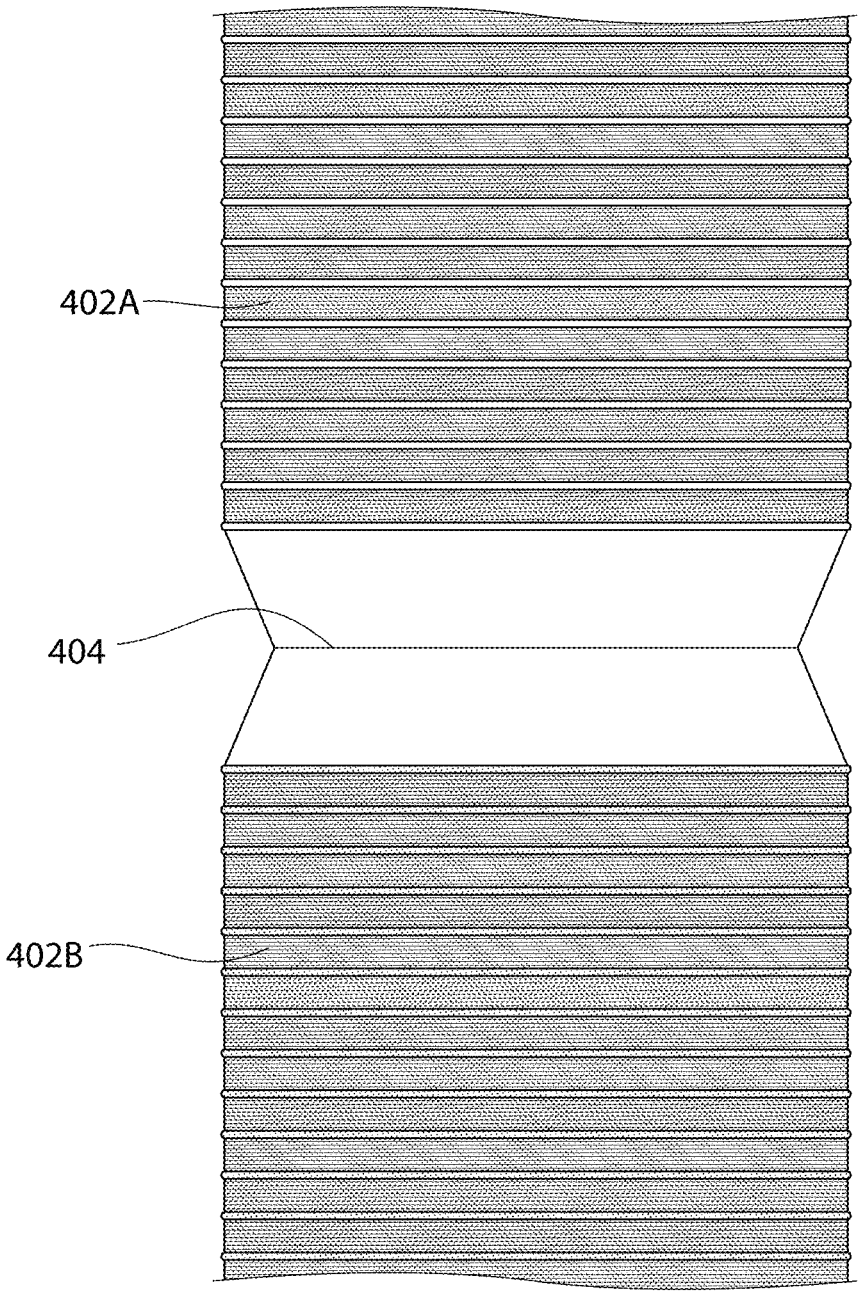
FIG. 5 shows a close-up view of the connector between two chambers of the clock.

Referring now to FIGS. 4 and 5, there are shown views of one embodiment of the present invention. In the illustrated embodiments, the clock 400 comprises a housing member having a first chamber 402A representing minutes and a second chamber 402B representing hours. Each of the chambers 402A, 402B of the housing member can be composed of a paper material or other suitable translucent material that allow some light to travel therethrough, wherein the material can be rigid or malleable. In the illustrated embodiment, the paper material can be pleated. The material for the housing member can comprise one or more layers. More layers can be used to allow less light to pass through the chambers or fewer layers can be used to allow more light to pass through the chambers. Additionally, the housing member can comprise diffusers integral thereto for diffusing light from the light assembly. In the illustrated embodiment, the housing member is composed of paper. More specifically, the housing member can comprise one or more layers, wherein the layers can alternate between opaque and translucent layers. The number of opaque layers and the translucent layers can be adjusted in order to filter more or less light therethrough.

The first chamber 402A and the second chamber 402B are connected via a connector 404. In various embodiments, the connector 404 can be composed of a metal such as brass or other suitable rigid materials. The connector 404 can comprise threaded elements to enable two or more chambers to removably attach threadably. In this regard, the length of the housing member of the clock 400 can be adjusted by adding or removing one or more chambers 402A, 402B.

The first chamber 402A and the second chamber 402B can be separated at least partially via a wall (not shown) at the connector 404 such that the first chamber and the second chamber are compartmentalized. Additionally, each of the first chamber 402A can be defined by a first volume and the second chamber 402B can be defined by a second volume. The first volume and the second volume can be different if the length of the first chamber 402A and the second chamber 402B are different. The first volume and the second volume can be the same if the length of the first chamber 402A and the second chamber 402B are equal. Alternatively, the first chamber 402A and the second chamber 402B need not be separated via a wall such that the housing member of the clock comprises a single defined volume.

Figure 6:
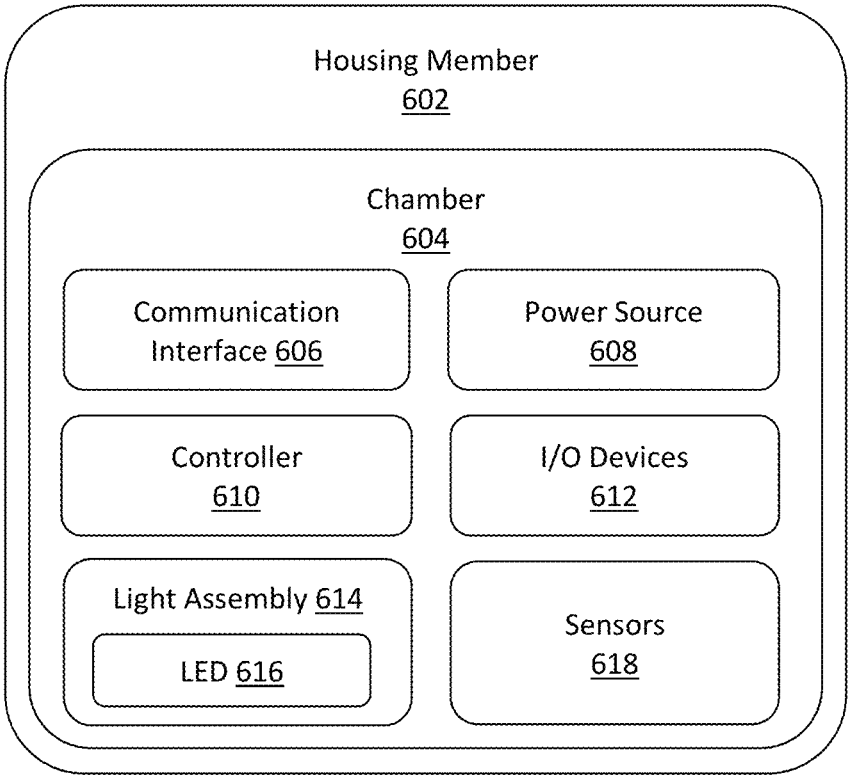
FIG. 6 shows a block diagram of the components of one or more chambers.

Referring now to FIG. 6, there is shown components of a housing member 602 comprising a chamber 604. The following "component(s)," "module(s)," "system(s)," "interface(s)," and/or so forth can be generally intended to refer to a computer-related entity, either hardware or a combination of hardware and software. For example, a component can be but is not limited to being, a process running on a processor, an object, and/or a computer. By way of illustration, both an application running on a controller and the controller can be a component. One or more components can reside within a process and/or thread of execution and a component can be localized on one computer and/or distributed between two or more computers. As another example, an interface can include input/output (I/O) components as well as associated processor, and/or application.

The chamber 604 comprises a controller 610 that is operatively connected to a communication interface 606, a power source 608 (e.g., batteries), hardware such as I/O devices 612, a light assembly 614 comprising LEDs 616, and one or more sensors 618. The power source 608 can be operatively connected to an AC/DC converter, bridge rectifier, capacitors, resistors, and/or so forth, depending upon embodiments. In various embodiments, one or more logic circuits, processors, microprocessors, microcontrollers, scalar processors, vector processors, central processing units (CPU), graphics processing units (GPU), digital signal processors (DSP), field programmable gate arrays (FPGA), integrated circuits, application specific integrated circuits (ASICS), etc., or any combinations thereof can be used in lieu of the controller 610. The controller 610 is configured to execute instructions to activate and operate the light assembly 614. Specifically, the controller 610 is configured to enable the light assembly 614 to show lighting effects, wherein the instructions can be stored in a memory unit coupled to the controller or the instructions can reside at least partially within the controller 610. Additionally, the controller 610 can be configured to keep real time. In various embodiments, the controller 610 can comprise a clock module or can be operatively connected to a clock or a timer for measuring time. In this way, the controller 610 can perform clock synchronization operations in order to keep time. Accordingly, the controller 610 enables one or more clocks to keep time in a synchronized manner.

The communication interface 606 may include wireless and/or wired communication components (e.g., Bluetooth™) that enable the controller 610 to transmit data to and receive data from other networked devices such as a remote controller operated by a user or other types of computing devices. Additionally, the communication interface 606 enables the controller 610 to communicate with other clocks, via, for example, Bluetooth™ mesh networking. In this regard, the controller 610 can communicate with one or more remote computing devices to adjust settings or configurations for the light assembly 614. The light assembly 614 can comprise one or more strips of LEDs 616 comprising one or more sets of LED bulbs. In various embodiments, the light assembly 614 can comprise other types of light bulbs that may be energy efficient such as compact fluorescent lamp (CFL). The light assembly 614 can also be operatively connected to the one or more sensors 618 such that one or more sets of LED bulbs can illuminate, for example, in accordance with one or more lighting effects based on one or more lighting conditions measured via the sensors 618.

In various embodiments, the I/O devices 612 can include any sort of output devices known in the art, such as a display (e.g., a liquid crystal display), speakers, a vibrating mechanism, or a tactile feedback mechanism. Output devices also include ports for one or more peripheral devices, such as headphones, peripheral speakers, or a peripheral display. In various embodiments, the I/O devices 612 include any sort of input devices known in the art. for example, input devices may include a camera, a microphone, a keyboard/keypad, or a touch-sensitive display. A keyboard/keypad may be a push button numeric dialing pad (such as on a typical telecommunication device), a multi-key keyboard (such as a conventional QWERTY keyboard), or one or more other types of keys or buttons, and may also include a joystick-like controller and/or designated navigation buttons, or the like.

It is submitted that the instant invention has been shown and described in what is considered to be the most practical and preferred embodiments. It is recognized, however, that departures may be made within the scope of the invention and that obvious modifications will occur to a person skilled in the art. Thus, the claimed subject matter can be implemented as a method, apparatus, or article of manufacture using standard programming and/or engineering techniques to produce software, firmware, hardware, or any combination thereof to control a computer to implement the disclosed subject matter. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The invention claimed is:

1. A visually readable clock device, comprising: at least one chamber having two ends and each chamber(s) representing a distinct unit of time; and one or more strip connected and substantially uniformly spaced lighting elements forming lighting assemblies extending from one end of each of the chambers towards the other end, within the at least one chamber, wherein the one or more lighting assemblies is connected to a timer controller and a source of power configured to illuminate individual of said lighting elements by turning the same on or off or dimming or brightening the same within the at least one chamber based at least partially on the passage of each unit of time.

2. The device of claim 1, wherein the unit of time is one day such that the at least one chamber is illuminated over a twenty-four hour period.

3. The device of claim 1, wherein the at least one chamber comprises a first chamber representing minutes and a second chamber representing hours.

4. The device of claim 1, wherein the at least one chamber comprises a first chamber representing minutes, a second chamber representing hours, and a third chamber representing days.

5. The device of claim 1, wherein the at least one chamber comprises a first chamber representing minutes, a second chamber representing hours, a third chamber representing days, and a fourth chamber representing years.

6. The device of claim 1, wherein the at least one chamber comprises a first chamber representing minutes, a second chamber representing hours, a third chamber representing days, a fourth chamber representing years, and a fifth chamber representing centuries.

7. The device of claim 1, further comprising a connector element connecting adjacent chambers of the at least one chamber wherein said connector serves to block visual bleeding of the lighting elements from one chamber into another.

8. The device of claim 1, wherein the at least one chamber is composed of thin stacks of alternating opaque and translucent material.

9. The device of claim 1, wherein the one or more lighting assemblies can display light effects selected from the group comprising: a falling drop of water, a glowing effect, a flash effect, a twinkling effect, a steady-on effect, an hourglass effect, dancing water effect, sloshing effect, and/or animation.

10. A visually readable clock device, comprising: a first chamber representing a first unit of standard time, the first chamber comprising an axially-extending first light assembly housed therein comprising a first set of strip-connected and substantially equally spaced LEDs, said LEDs not being viewable directly from the exterior of said first chamber, configured to illuminate the first chamber based at least partially on the first unit of standard time; and a second and adjacent chamber representing a second and distinct unit of standard time, the second chamber comprising a second set of strip-connected and substantially equally spaced LEDs, said second light assembly configured to illuminate the second chamber based at least partially on the second unit of standard time.

11. The device of claim 10, wherein the first light assembly and the second light assembly are operatively connected through a controller and power source to coordinate lighting effects of the first light assembly and the second light assembly selected from one or more of the following: a falling drop of water, a glowing effect, a flash effect, a twinkling effect, a steady-on effect, an hourglass effect, dancing water effect, sloshing effect, and/or animation.

12. The device of claim 10, further comprising a connector connecting the first chamber and the second chamber wherein said connector serves to block light bleeding from said first chamber to said second chamber.

13. The device of claim 10, wherein the first set of LED bulbs is configured to illuminate dim and/or brighten at a rate and/or intensity based at least partially based on the relative elapsed time and/or length of each of the number of the first set of LED bulbs of said first chamber.

14. The device of claim 11, wherein the first light assembly of said first chamber triggers the second light assembly of said second chamber to partially illuminate dim or brighten at least one light bulb of the second light assembly after a predetermined period of time.

15. The device of claim 14, wherein the first light assembly resets upon after completely illuminating the first set of light assembly of said first chamber.

16. A visually readable clock device, comprising: a housing member comprising one or more adjacent chambers, each of the one or more chambers representing a distinct unit of time; one or more strip-connected and evenly spaced lighting components of lighting assemblies extending through the one or more chambers, wherein the one or more lighting assemblies is configured fully or partially or illuminate by activating, brightening or dimming each of the elements of the lighting assemblies based at least on the unit of time corresponding to the one or more chambers.

17. The device of claim 16, wherein the one or more lighting assemblies is configured to display light effects selected from one or more of the following: a falling drop of water, a glowing effect, a flash effect, a twinkling effect, a steady-on effect, an hourglass effect, dancing water effect, sloshing effect, and/or animation.

18. The device of claim 16, wherein the one or more lighting assemblies comprises a plurality of LED bulbs extending through the one or more chambers.

19. The device of claim 16, wherein the one or more chambers are provided with a light bleeding blocking mechanism.

* * * * *